United States Patent [19]

Riley

[11] 3,994,218

[45] Nov. 30, 1976

[54] ENERGY ABSORBING PRINT HAMMER BUMPER WITH INTERNAL STABILIZER

[75] Inventor: Arthur F. Riley, Chicago, Ill.

[73] Assignee: Teletype Corporation, Skokie, Ill.

[22] Filed: Dec. 18, 1974

[21] Appl. No.: 534,024

[52] U.S. Cl. ..... 101/93.02; 197/42; 335/271

[51] Int. Cl.[2] ..... B41J 9/42

[58] Field of Search ..... 101/93.02, 93.28, 93.34, 101/111, 31; 74/237; 335/257, 271, 248; 267/152, 153, 140, 141; 197/42

[56] References Cited

UNITED STATES PATENTS

| | | | |
|---|---|---|---|
| 837,920 | 12/1906 | Felbel | 197/42 |
| 2,625,100 | 1/1953 | Williams et al. | 101/93 |
| 3,292,531 | 12/1966 | Mutz | 101/93 |
| 3,296,958 | 1/1967 | Liepelt | 101/31 |
| 3,386,376 | 6/1968 | Mutz et al. | 101/93.02 |
| 3,418,929 | 12/1968 | Nelson | 101/111 |
| 3,670,647 | 6/1972 | Funk et al. | 101/93.02 X |
| 3,726,213 | 4/1973 | Herbert | 101/93.03 X |
| 3,791,292 | 2/1974 | Soderstrom et al. | 101/111 |
| 3,823,667 | 7/1974 | Babler | 101/93 |
| 3,826,191 | 7/1974 | Pittis et al. | 101/103 |

FOREIGN PATENTS OR APPLICATIONS

| | | | |
|---|---|---|---|
| 1,379,645 | 6/1972 | United Kingdom | 101/93.48 |

*Primary Examiner*—Edgar S. Burr
*Assistant Examiner*—Edward M. Coven
*Attorney, Agent, or Firm*—K. R. Bergum; W. K. Serp; M. Pfeffer

[57] ABSTRACT

An elongated energy absorbing bumper assembly, particularly adapted for use in absorbing the kinetic energy induced print hammer forces produced in impact printers and the like, is comprised of an outer resilient body portion, and an axially disposed stabilizing rod. The stabilizing rod is employed to substantially minimize the troublesome "kneading" or stretching effects that have otherwise often been encountered heretofore with conventional one-piece elongated bumpers made out of materials exhibiting the requisite resiliency and viscous damping characteristics. Such detrimental effects have developed heretofore both during the assembly of the bumper in the hammer mechanism, and during use thereafter. As a result of the stabilizing rod minimizing dimensional changes in the outer resilient body portion of the bumper assembly along its axial length, the energy absorbing (or damping) characteristics thereof will permanently remain substantially uniform therealong.

In an alternative embodiment, the stabilizing rod is of tubular construction and optionally allows a temperature controlled heater element to be axially disposed therewithin. Such a heated bumper assembly is particularly advantageous for use in printers, such as of the mobile type, that are often operated in environments wherein the temperature may vary over a considerably wide range.

6 Claims, 7 Drawing Figures

FIG. 2
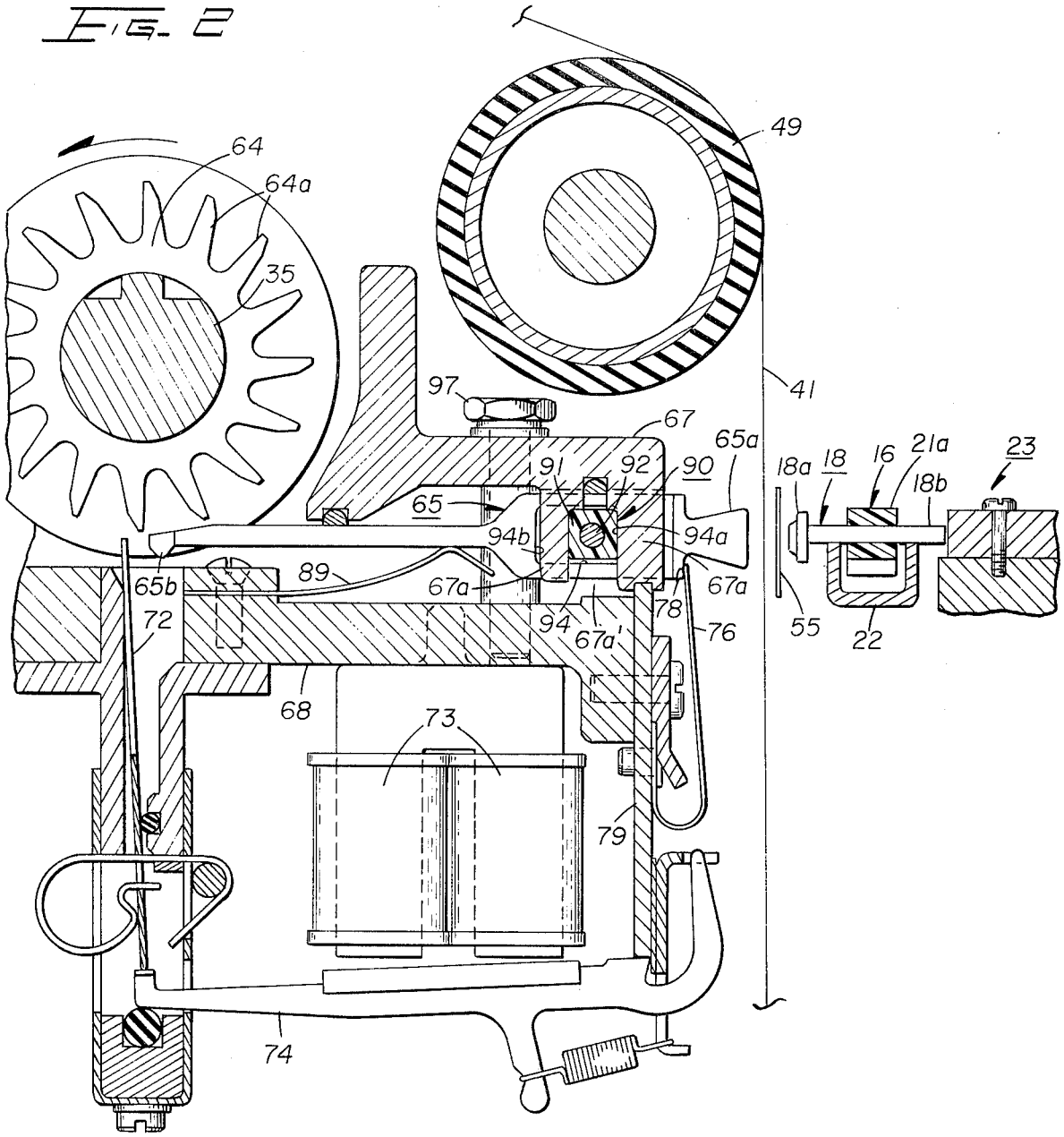
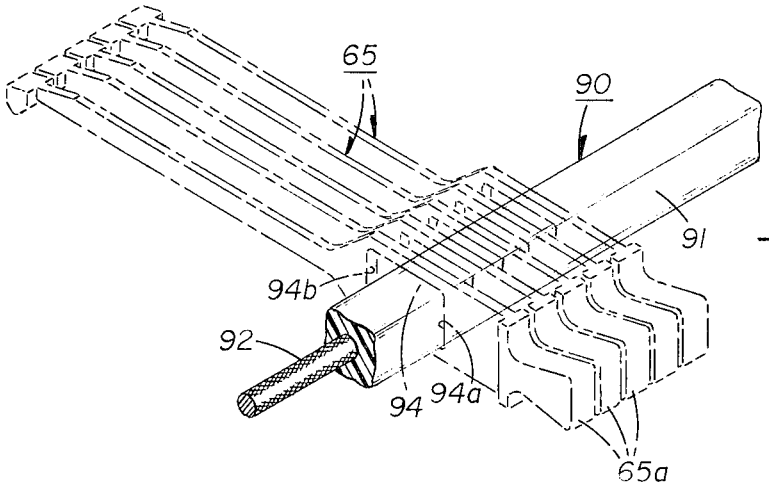
FIG. 6

ENERGY ABSORBING PRINT HAMMER BUMPER WITH INTERNAL STABILIZER

BACKGROUND OF THE INVENTION

1. Field of the Invention

The present invention relates to high speed impact printers and, more particularly, to impact cushioning and rebound damping apparatus for the print hammers thereof.

2. Description of the Prior Art

Impact printers of the type with which the present invention is primarily concerned effect printing "on-the-fly" at relatively high speeds. More specifically, in one class of such printers, the character dies or type which are arranged to form a given front are mounted in a longitudinal array on a continuously moving carrier which is drawn past an aligned array of selectively actuable print hammers. Interposed therebetween, of course, is the print medium, such as paper in roll stock form, on which characters are to be printed, and a reversibly driven inked (or carbon impregnated) ribbon.

In order to maximize printing speed, it is obvious that the hammers must have a low mass, and be propelled at high speed with minimal friction. To that end, most hammers are of the so-called inertial type, i.e., hammers which upon being subjected respectively and selectively to abrupt impact or driving forces, are thereafter propelled into the print area under their own inertia. While such hammer operation is conducive to high speed printing, it has imposed a serious problem heretofore in regard to effectively damping the kinetic energy imparted return force, as well as any rebound or oscillatory forces, of each print hammer, which forces are often augmented by a spring-biased hammer return force.

Such impact hammer forces if not absorbed or damped in some way, can very readily result in a given print hammer, after reaching a backstop (which defines a retracted non-printing or rest position), rebounding off the backstop in a forward (print) direction with sufficient velocity so as to again impinge against the paper. This, of course, would result in the printing of unintended character images on the paper.

A number of techniques have been employed heretofore to prevent the aforementioned troublesome and detrimental rebounding hammer motion. For example, in one class of printers wherein the magnetic attractive force of core pole faces of an energized solenoid are utilized to effect the "firing" of an associated hammer, a predetermined amount of applied current is maintained in the solenoid coil (or coils) during the rebound return of the hammer to a rest position so as to establish a dynamic type of (opposed field) braking action against the returning hammer. Unfortunately, such prolonged energization of the coil (or coils) substantially doubles the duty cycle of the solenoid, as well as increases the current requirements for the hammer drive mechanism.

In other electromagnetically operated hammer drive systems, wherein the armature of the solenoid, for example, is utilized either directly or indirectly through a coupled actuator to fire the associated hammer, a second independent electromagnet has often been employed heretofore to magnetically attract and hold the rebound-returned hammer against an associated backstop or bumper until the hammer is again intentionally fired. Such an arrangement has the disadvantage, however, of increasing the costs and complexity of the hammer mechanism, and further necessitates a substantial increase in the current requirements of the print hammer drive circuitry.

A more simplified approach to damping hammer rebound forces or oscillations has involved the use of a resilient, shock absorbing type of bumper in combination with one or more recoil springs. Resilient bumpers have also been employed heretofore in conjunction with the aforementioned types of electromagnetic damping systems.

With particular reference to the resilient bumper per se, in one preferred type of impact printer it has taken the form of an elongated bar which passes through a keying slot formed in each of an array of laterally spaced print hammers. The keying slots are dimensioned such that the hammers impact against and are controllably cushioned by the bumper during the firing of each hammer against the paper (to effect the imprinting of a character thereon), as well as after rebounding off of the paper (after the latter has been driven against a type character die on the backside thereof), and upon return to a rest position. A different leaf spring associated with each hammer further augments the rapid return of each hammer from the forward print position to a retracted rest position. Such a hammer-bumper arrangement is disclosed in E. S. Babler, U.S. Pat. No. 3,823,667, issued July 16, 1974, assigned to the assignee of the present invention, and incorporated herein by reference.

The bumper in such a print hammer mechanism has generally been molded out of a suitable elastomer, such as a polyurethane material exhibiting a durometer Shore hardness of about 90A. While such a bumper material has been found to ideally exhibit the desired resiliency or viscous damping effect, i.e., under controlled or laboratory conditions, in practice, this has not always been the case. Rather, elongated resilient bumpers made of the aforementioned material (as well as other known materials exhibiting similarly sought characteristics), have been found to produce unpredictable and inconsistent energy absorbing characteristics along their length.

More specifically, investigation has lead to the realization that an elongated bumper when made of the abovedescribed (or other known) material initially exhibiting the desired energy absorbing characteristics, has had a tendency to stretch or produce a kneading effect not only during the mounting thereof in the print hammer assembly, but during actual printing as a result of the random initial impact and rebound forces exerted thereagainst by the print hammers. Stated another way, elongated resilient bumpers of the type in question, that are common to an array of print hammers, have been found to acquire very detrimental, cross-sectional dimensional variations along their length, albeit not often visible to the naked eye, as a result of both physical handling during assembly, and the random kinetic induced forces exerted thereagainst by the print hammers during normal use.

This, in turn, results in the print hammers either directly or indirectly (through rebound or oscillatory motion) being propelled against a web or paper with randomly different velocities. In the case of rebound driven print hammers, of course, this often results in unintended characters being at least lightly imprinted on the paper. With respect to intended characters to be printed, appreciable variation in print hammer velocity from a desired norm can often lead to characters being printed along a given line with very noticeably different, and often unacceptable, line contrast or definition. Considered another way, character printing with variable line definition can very easily result if the kinetic energy induced forces of the fired print hammers are not uniformly absorbed along the axial length of the resilient body portion of the bumper at a rate which is equatable to the change in velocity of each of the hammers.

Further contributing to the above problems is the fact that extreme variations in temperature can also adversely affect the resiliency or viscous damping characteristics exhibited by a bumper made of a given plastic elastomer. This is particularly true when the printer is exposed to diverse environments such as encountered in many mobile printer applications.

SUMMARY OF THE INVENTION

It, therefore, is an object of the present invention to provide a new and improved energy absorbing bumper assembly for use as a common intermediate impact cushioning member during the selective firing of an array of print hammers to effect printing, and as a common backstop to damp the otherwise experienced deleterious rebounding or oscillations of the hammers upon their return to a rest position.

It is a further object of the present invention to provide energy absorbing print hammer bumper assemblies of simplified and inexpensive construction, and which bumpers exhibit consistently reliable force-induced energy absorbing characteristics that are not appreciably affected by the assembly or use thereof within an impace printer, even when subjected to extreme variations in environmental conditions.

In accordance with the principles of the present invention, these and other objects are realized in one preferred illustrative embodiment wherein an elongated energy absorbing print hammer bumper assembly is formed with an outer resilient body portion, preferably comprising an elastomer, such as a polyester (or polyether) base urethane exhibiting a predetermined Shore hardness and impact resilience, and an inner elongated stabilizing rod, preferably of metal, disposed axially along the entire length of the resilient body portion and preferably embedded, or at least rigidly secured, therewithin. The composite bumper assembly is most readily formed in a suitable mold, with the stabilizing rod having a knurled (or otherwise roughened) outer surface so as to ensure intimate, adhering contact between the rod and the homogeneous resilient bumper material in contact therewith.

With respect to the resilient body portion of the bumper assembly, the material therefor is also preferably chosen to be viscoelastic in nature so that any kinetic energy imparted forces applied thereagainst, as a result of the return travel of the hammers are substantially, if not completely, absorbed and dissipated in the form of heat. Moreover, and significantly, such a resilient body portion is capable of absorbing the kinetic energy immediately as it develops, so that no detrimental transient hammer bounce forces (oscillatory movement of the hammers) develop.

As for the stabilizing rod, it may be made out of any suitable metal or plastic material that exhibits the tensile strength, rigidity, and thermal coefficient of expansion characteristics required in order to substantially minimize the tendency of the elongated resilient body portion of the bumper assembly to stretch or produce a kneading effect. Such effects, as previously mentioned, have been found to occur heretofore in an unstabilized bumper not only during the assembly thereof in a printer, but as a result of the random and periodic impact forces exerted thereagainst by the print hammers during normal use, and particularly under variable environmental operating conditions. Regardless how such detrimental effects have arisen in the past, the stabilizing rod embodied herein will substantially minimize any variations in the cross-sectional dimensions of the resilient body portion of the bumper assembly along its axial length, and thereby maintain the energy absorbing characteristics therealong substantially constant with respect to most printer applications.

In accordance with a second preferred embodiment of the invention, the stabilizing rod is dimensioned so as to support an internal heater along the axial length thereof. Such a heater may, for example, comprise a fine gauge helically wound wire element. When such a heater is employed with a suitable thermostatically controlled low wattage power source, it will effectively eliminate detrimental variations in the resiliency or viscous damping characteristics that might otherwise occur with a given bumper material exhibiting a particular thermal coefficient of expansion. It, of course, is realized that an extreme reduction in temperature can affect a number of other physical characteristics of a bumper material of the type in question, such as its brittleness and wear resistance, to mention several. These characteristics also have a direct or indirect bearing on the energy absorbing characteristics of a bumper, and particularly in a sensitive impact printer application of the type with which the present invention is concerned.

A stabilized and heated elongated bumper of the type embodied herein is thus seen to have particular application where extreme variations in temperature and/or humidity are encountered. Advantageously, as the heating element need only generate a fractional part of a watt to be effective for the purpose intended herein, the power source may comprise a small battery pack as well as a commercial a-c outlet.

BRIEF DESCRIPTION OF THE DRAWINGS

FIG. 2 is an enlarged, vertical sectional view taken along the line 2—2 of FIG. 1, showing in greater detail the print hammer firing mechanism for the printer of FIG. 1;

FIG. 6 is a perspective detail view, partially broken away, showing one preferred form of the elongated energy absorbing print hammer bumper, with a stabilizing rod extending axially therethrough, in accordance with the principles of the present invention.

DETAILED DESCRIPTION OF THE INVENTION

Background of the Invention

Figure 1:
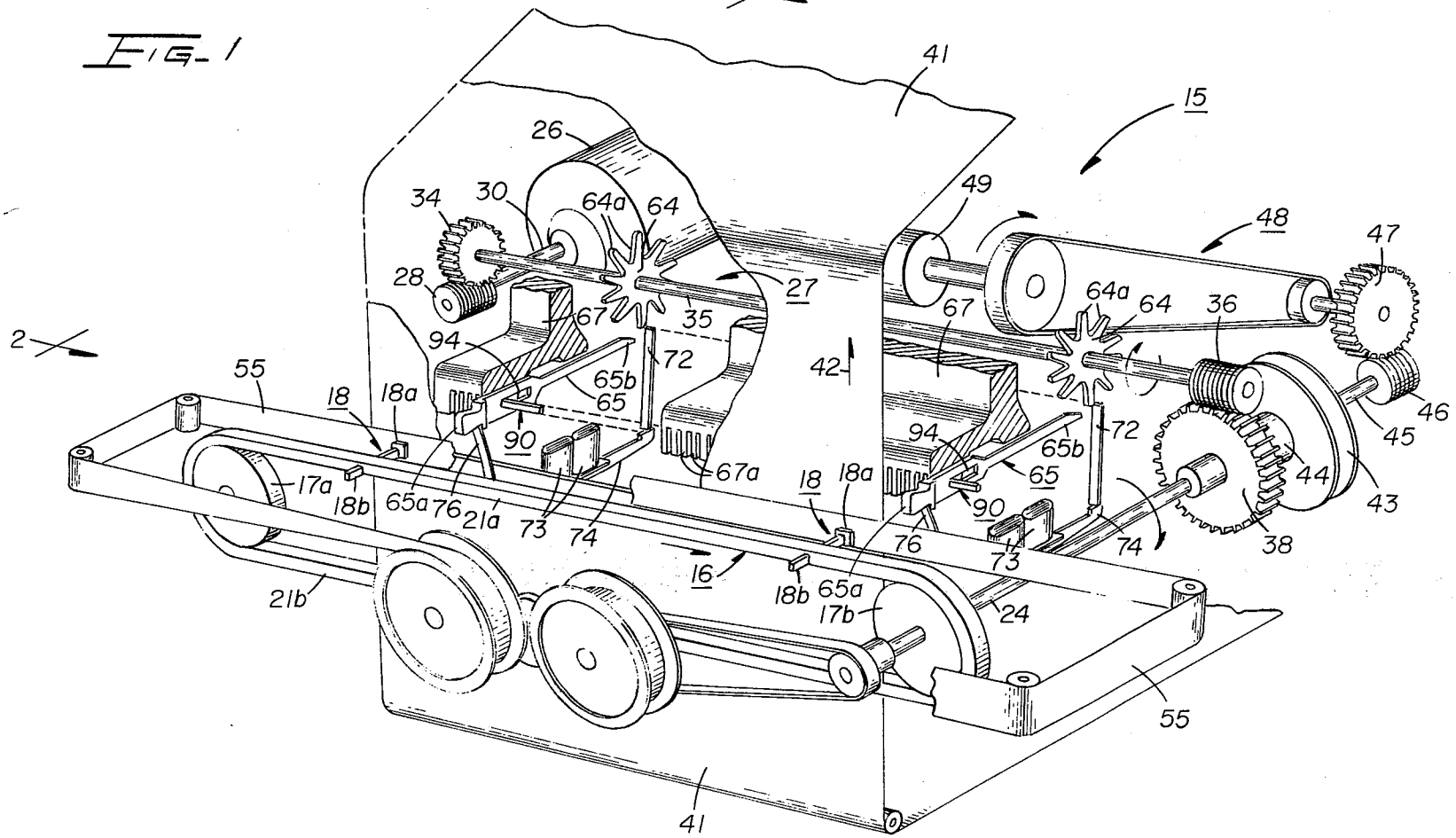
FIG. 1 is a partially broken away perspective view of an illustrative high speed impact printer, with some parts being omitted for the purposes of clarity, incorporating a unique print hammer bumper assembly embodying the principles of the present invention.

As previously mentioned, the energy absorbing bumper assemblies embodied herein have universal application as shock absorbers, but for purposes of illustration herein, they are disclosed for use in conjunction with a high speed, on-the-fly impact printer of the type depicted in FIG. 1, and identified generally by the reference numeral 15. Such a printer is of the class that utilizes an endless type carrier 16 entrained about a pair of spaced and aligned sprockets or pulleys 17*a*, 17*b*, which are journaled by any suitable means on the frame (not shown) of the printer. The carrier 16, which may comprise a chain or a toothed timing belt, is adapted to transport a plurality of type pallets 18 (only two shown in FIG. 1) in an essentially orbital path, which is oriented so as to define upper and lower linear line printing courses 21*a*, 21*b*, with the former being coextensive with the line printing area of the printer.

Figure 4:
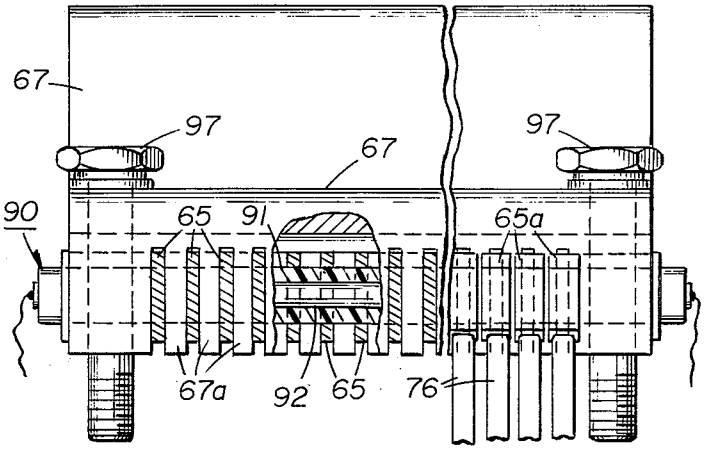
FIG. 4 is a vertical end view, partially in section, taken along the line 4—4 of FIG. 2, showing in greater detail the laterally disposed array of print hammers relative to the common energy absorbing bumper associated therewith.
Figure 3:
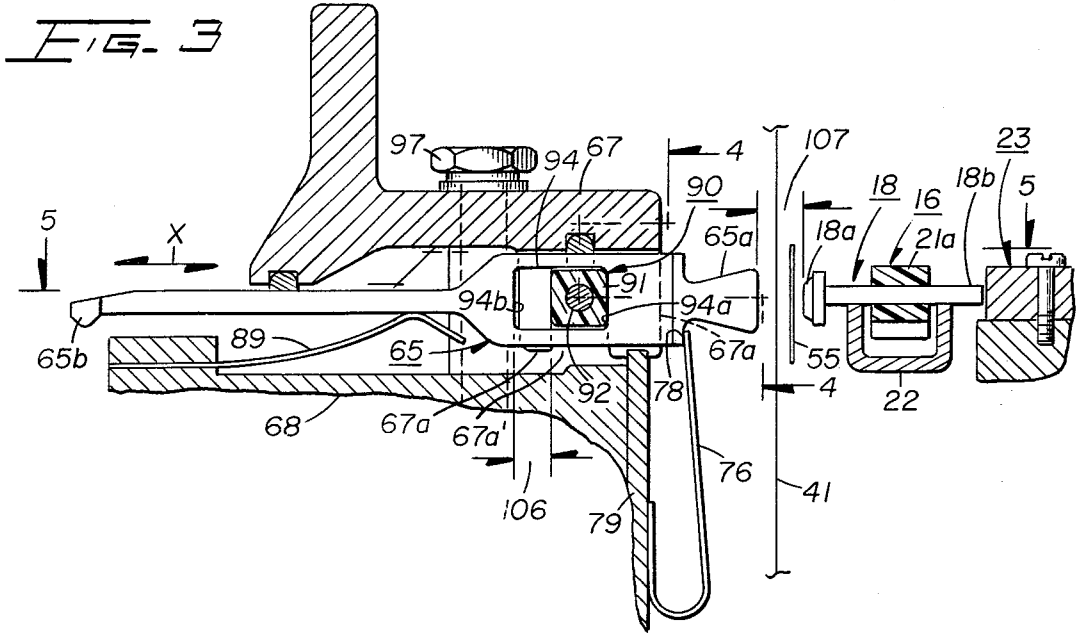
FIG. 3 is an enlarged, side elevational view, partially in section, illustrating the print hammer, bumper and type pallet-carrier assemblies for the printer of FIG. 1.

Each of the type pallets 18 (as best seen in FIGS. 2 and 3) has a front face portion having a type character die 18*a* secured thereto or otherwise formed as an integral part thereof. The pallets 18 are uniformly spaced along and oriented transversely of the carrier 16 (as best seen in FIG. 4) by means of an integral shank portion 18*b* that extends through suitably formed channels (not shown) formed in the carrier. In a preferred embodiment, there are normally at least twice as many type pallets-characters than in any chosen font. This means that a given sequence of characters is repeated more than once along the entire length of the carrier. The upper course 21*a* of the carrier 16 is guided along a U-shaped support member 22 (see FIG. 3), with an adjustable back stop, designated generally by the reference numeral 23, being employed to adjust the forward positions of the aligned array of type pallets 18 transported on the carrier. For further details as to one preferred embodiment of the carrier 16 and type pallets 18, reference is made to a commonly assigned U.S. Pat. No. 3,742,848, of Huntoon-Kearney, herein incorporated by reference.

In the illustrative embodiment of the printer depicted in FIG. 1, carrier pulleys 17*a* and 17*b* constitute idler and drive pulleys, respectively. Driving torque is continuosly transmitted to the pulley 17*b* through a shaft 24 which is coupled to a prime mover, herein shown as a motor 26, through a drive train designated generally by the reference numeral 27 in FIG. 1. The drive train includes a worm gear 28 secured to the shaft of the motor 26, a gear 34, operably enmeshed with worm gear 28, and secured to one end of an elongated drive shaft 35. A worm gear 36, secured to the other end of the drive shaft 35, is enmeshed with a gear 38 that, in turn, is secured to the shaft 24.

Motor 26 also effects the line feeding of incremental advancement of a web 41, such as paper in roll stock form on which printing is to take place, in the direction shown by arrow 42. This is accomplished with a clutch 43, which may be of conventional design, that is mounted in juxtaposition with the gear 38 so as to releasably couple a split shaft 44 to the coextensively aligned shaft 24. Selective actuation of the clutch is effected through conventional logic control circuitry (not shown), which forms no part of the present invention. Whenever the clutch 43 is operated, it couples the shaft 24 to a shaft 45 which, in turn, through a worm gear 46, a gear 47 and a drive belt and pulley assembly 48, incrementally rotates a cylindrical platen 49, which frictionally engages and advances the web or paper 41.

In the interest of simplicity and clarity, support structure for driving elements, including the main frame of the printer, has generally been omitted herein, other than to the extent shown in fragmentary form in FIG. 2. For further details of such support structure, as it pertains to a very similar drive train for both the type carrier 16 and the web 41, reference is again made to the Huntoon-Kearney patent.

In order to effect the imprinting of type character images on the paper or web 41, an inked ribbon 55 is continuously driven selectively in one direction or the other between, and in alignment with, the array of type pallets 18 and the web 41. One preferred embodiment of an improved ribbon spool driving, reversing and tensioning mechanism for use with a printer of the type depicted in FIG. 1 is disclosed in my prior U.S. Pat. No. 3,825,103, also incorporated herein by reference.

With particular attention now directed to FIGS. 2 and 3, the print hammer driving mechanism further comprises both an array of spoke-like impellers 64 (only two shown in FIG. 1), and a plurality of respectively associated impacters, or print hammers, designated generally by the reference numeral 65 (only two shown in FIG. 1). There is one impeller and associated hammer for each possible print position (or column) disposed across the width of the web 41, with the spaced impellers 64 being concentrically secured to the longitudinally extending drive shaft 35.

As best seen in FIG. 2, each impeller 64 has a plurality of radially extending, uniformly spaced, spoke-like elements 64*a*, all of which are oriented in a common plane perpendicular to the axis of the shaft 35. In a preferred embodiment of the printer, the impellers 65 are preferably arranged in a manner as disclosed in a second U.S. Pat. No. 3,795,187, of E. S. Babler, herein incorporated by reference.

Each hammer 65 is mounted in a channel defined between upper and lower wall members 67 and 68, respectively (see FIG. 2), which form portions of the printer frame. Such channels, in conjunction with side wall guides (not shown), and a biasing spring 89, allow each hammer to be selectively driven along a rectilinear path, perpendicular to the web 41. The limits of this path are defined between a normal, untensioned, or non-print position (as depicted in FIG. 3), and a print position (as depicted by the hammer 65A in FIG. 4), whereat an enlarged forward head portion 65*a* of each hammer is propelled against the backside of the web 41. Further details of the hammer mounting and actuating structure is described in the aforementioned E. S. Baber patent, U.S. Pat. No. 3,823,367.

It is apparent that in order to effect the printing of any given character in any one of the print columns along a given print line, every type pallet must momentarily be brought into registry with every print hammer at some point in time during each print cycle. In that connection, it is generally preferable that the center-to-center spacing between adjacent type character pallets be wider than the corresponding spacing between adjacent print hammers, which is referred to as a pitch relationship therebetween. Such a type characterhammer relationship is employed to prevent a so-called "ghosting" or shadow printing phenomenon which may occur as a result of a print hammer in normally impacting a discrete area of the paper against the type character to be printed, also creating sufficient pressure to produce a slight impression on the paper of the edge of a type character adjacent to the character being printed. A preferred type character-print hammer pitch relationship, including dimensions, mode and sequence of operation, is described in the aformentioned Babler patent, U.S. Pat. No. 3,795,187.

An interponent 72 (only two shown in FIG. 1, and best seen in FIG. 2), is employed to translate the driving force of an associated impeller 64 to an aligned hammer 65 so as to propel the latter against the backside of the web 41. Each of the interponents 72 essentially comprises an elongated upright finger-like member, operably associated with one particular impeller 64 and hammer 65. The interponents are disposed in a lateral array, oriented essentially vertically, and respectively aligned with the adjacent free rearward ends **65*b* of the horizontally disposed hammers 65. The described interponents 72** are preferably supported and actuated in accordance with a third E. S. Babler patent, U.S. Pat. No. 3,822,641, herein incorporated by reference.

For the purposes of understanding the present invention, it will suffice to simply state that each interponent 72, in response to a respectively and selectively energized one of a plurality of electromagnetic assemblies 73, and a responsively pivoted armature 74, can be actuated into either one of two operating positions. In a first or vertically raised upper position, the upper free end portion of each interponent 72 is disposed in the path of movement of a then immediately adjacent impeller spoke **64*a* (for transmitting force from the aligned impeller 64 to an aligned hammer 65), in consequence of which printing occurs. In the second or vertically lower non-printing position, the upper free end portion of each interponent 72 is displaced from the path of an impeller spoke 64*a***.

To further facilitate retractable hammer movement, a separate U-shaped leaf spring 76 is associated with each hammer 65, with the upper end of the longer leg portion of each spring being biased against an undercut shoulder 78 (best seen in FIGS. 2 and 3), which is formed in the underside of the enlarged forward portion **65*a* of the hammer. The upper end region of the shorter leg of each leaf spring 76 is rigidly secured in any suitable manner to a front chassis plate 79 (see FIG. 2). Each leaf spring 76 is in a relatively unbiased condition when the associated hammer 65 is in its rearward nonprinting position, and is in a spring-biased condition during printing, when it urges its associated hammer backward, or away from the web 41 to a nonprinting position. This cannot occur, however, until after the rearward free end 65*b* of the hammer has been released by its associated interponent 72.**

For further information relating to the cooperating mechanical relationship between the impellers 64, hammers 65, and interponents 72, reference is made to the three Babler patents previously cited hereinabove. As for the electromagnetic assemblies, they are preferably constructed, arranged, and energized in the manner described in a commonly assigned U.S. Pat. No. 3,785,283, of J. F. Kearney, also incorporated herein by reference. Details as to the manner in which the associated armatures 74 are mounted and pivoted are described in accordance with one preferred embodiment disclosed in a fourth Babler patent, U.S. Pat. No. 3,805,695, likewise incorporated herein by reference.

For further information in regard to the manner in which the electromagnets 73 may be selectively energized so as to effect the firing of the respectively associated hammers 65, which facilities form no part of the present invention, reference is made to the unique hammer control logic circuitry disclosed in a commonly assigned U.S. Pat. No. 3,845,710, of D. A. Brodrueck, which control circuitry is preferably synchronized with the continuously driven endless type carrier 16.

Energy Absorbing Bumper Assembly

With the foregoing general description of one particular impact printer utilizing selectively actuable print hammers and a continuously moving endless type carrier as background, attention is now directed specifically to an elongated, energy absorbing bumper assembly 90 which is particularly adapted for use in the print hammer mechanism of such a printer.

As best seen in FIG. 6, the bumper assembly comprises an outer resilient body portion 91 and an inner, axially disposed stabilizing rod 92. The nature of the materials employed for the bumper assembly, and the characteristics desired in the parts made of such materials, will be described in greater detail hereinbelow.

With particular reference to FIGS. 3 and 6, it is seen that the bumper assembly 90 is employed both to facilitate the guidance of each hammer during the reciprocal travel thereof, and to limit such travel. This is accomplished by the elongated bumper assembly 90 being dimensioned so as to extend through a longitudinally disposed keyway or slot 94 formed in each of the hammers. These slots, of course, are dimensioned relative to the cross-sectional dimensions of the bumper assembly so as to allow the requisite reciprocal movement of the hammers relative to the stationary bumper assembly during each print cycle.

Figure 5:
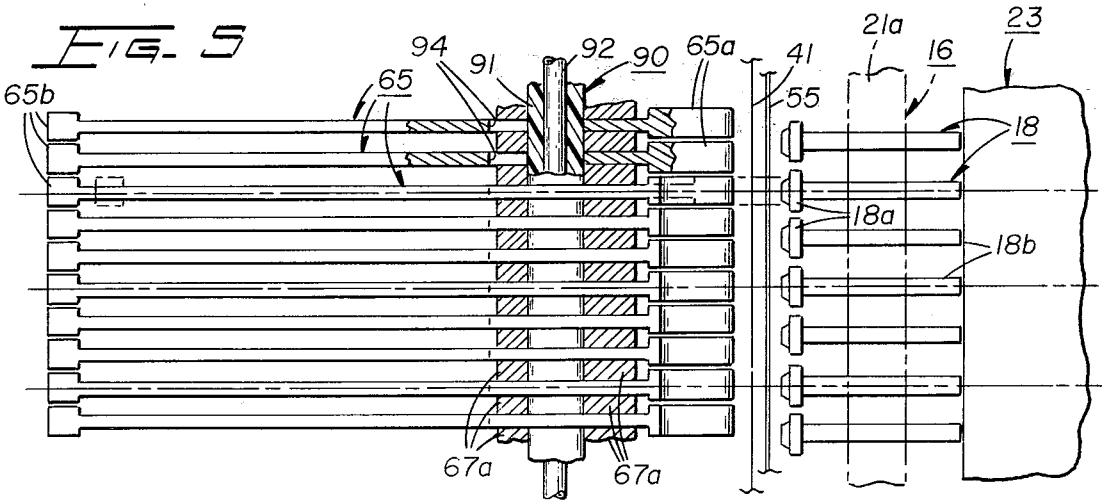
FIG. 5 is a fragmentary detail horizontal view taken along the plane 5—5 of FIG. 3, with certain parts omitted for the purpose of illustration, showing the intercoupled relationship between the print hammers and the common energy absorbing bumper.

The bumper assembly 90 is firmly supported at a plurality of discrete points along its length by a spaced array of slotted comb-like fingers **67*a* (best seen in FIG. 3) that are formed as an integral part of the upper frame support member 67. The fingers are respectively interposed between successively adjacent pairs of hammers 65 in an interleaved fashion, as best seen in FIGS. 4 and 5. Each of the fingers 67*a* has a slot 67*a'* (see FIG. 3) formed therein which communicates with a bottom edge of the comb-like portion of the member 67. The slots 67*a'* are dimensioned so as to allow the bumper assembly 90 to be force-fit inserted upwardly therewithin during the assembly of the print hammer mechanism of the printer. Two threaded members 97 (see FIGS. 2 and 4) extend through respectively aligned pairs of tapped holes in the upper and lower printer support members 67 and 68 so as to secure these members permanently together while defining the aforementioned laterally disposed array of channels in which the print hammers 65** are mounted for reciprocal movement.

In accordance with the principles of the present invention, the bumper assembly 90 is employed to accomplish considerably more than to simply function as a guide member and a conventional stop for hammer travel. More importantly, as briefly mentioned hereinabove, the bumper assembly is also employed not only in connection with controlling the impact force exerted against variable thicknesses of paper by the fired hammers initially, but in connection with absorbing the kinetic energy induced rebound bounce forces of the hammers, without appreciable oscillatory motion, upon their return to a non-printing or rest position, as illustrated in FIGS. 2, 3 and 5.

The importance of having an energy absorbing bumper that consistently exhibits a predetermined and uniform degree of resiliency along its length during the random firing of the hammers is best appreciated by examining the manner in which the bumper is intended to restrict hammer travel in the illustrative printer 10. With particular reference to FIG. 3, it is seen that the disposition of the bumper assembly 90 in the successive, laterally aligned hammer slots 94 is such that the bumper limits movement of each hammer in both the forward fired and backward (rebound) directions along a printing axis designated X.

Such restricted hammer travel is accomplished by dimensioning the length of each hammer slot 94 relative to the cross-sectional dimensions of the bumper 90 such that the front and rear edges 94*a* and 94*b* of the slot alternately engage the bumper during a hammer firing cycle.

Considered more specifically, in the initial or non-printing position of the hammer 65, the leaf spring 76 biases the hammer to the left (as best seen in FIG. 3) to a rest position whereat the front inner edge 94*a* of the slot 94 is in contact with the adjacent rear wall of the bumper 90. The longitudinal length of the slot 94 is dimensioned, relative to the horizontal width of the bumper such that a predetermined clearance identified by the numeral 106 is provided between the rearward slot edge 94*b* and the adjacent wall of the bumper along the X axis of hammer travel. This clearance or space is chosen such that for the thickest number of plies or sheets of paper intended to be accommodated in the horizontal space identified by the numeral 107 (between the forward end of a given print hammer 65 and the front face of support type die aligned therewith), the rearward slot edge 94*b* will just come into contact with the adjacent rear wall of the bumper 90, when a given hammer 65 reaches a print position.

Thus, to the extent that the thickness of the paper mass in the space identified by the numeral 107 is reduced from such a maximum, each hammer 65 will move further to the right (relative to FIGS. 2 and 3), compressing the bumper 90 by a progressively increasing amount, until it reaches the printing position shown in phantom lines for the third hammer 65 as viewed from the top in FIG. 5.

After a given hammer has been fired, of course, the kinetic energy induced impact force of the hammer against the paper-ribbon-die combination, together with the rearward directed biasing force exerted by the leaf spring 76, propels each fired hammer rapidly to the left to a rest position, as viewed in FIGS. 2 and 3. This position is effected by the forward slot edge 94*a* of each rebounded hammer impacting against the adjacent forward wall of the bumper assembly 90.

Ideally, the common bumper 90 is intended to completely damp the rebound energy of the hammers, which energy could otherwise possibly lead to the printing of undesired characters. Short of that happening, however, it is extremely important that the bumper 90 be capable of very rapidly damping all oscillatory motion of the rebound-returned hammers so that they acquire a quiescent state preparatory to their being fired again, which may often occur within a fraction of a second in high speed printers.

To accomplish such abruptly terminated hammer travel, the kinetic energy induced print hammer impact or bounce forces should be absorbed at a rate, as previously mentioned, which is equatable to the change in velocity of the hammers. To that end, and in accordance with the principles of the present invention, it has been found very advantageous to make the resilient body portion of the bumper assembly out of a material which exhibits a so-called viscoelastic characteristic, i.e., a material basically elastic in nature, but having appreciable viscous properties. Such a material has the ability to absorb energy, such as when subjected, to a strain in the form of a force exerted thereagainst, without producing appreciable physical deformation, and to thereafter restore itself upon release of the force by dissipating the absorbed (or stored) energy in the form of heat.

It has been found that a material exhibiting a durometer Shore hardness in the range of 60A–95A, with a simultaneous Shore impact resilience by vertical rebound reading not exceeding 8 percent, will produce the beneficial results desired. One preferred plastic material found to exhibit the aforementioned desired characteristics is a polyester base urethane sold commercially for end use by Chemi-Flex Products, Inc., Addison, Illinois.

Also in accordance with the principles of the present invention, the problems encountered heretofore in connection with a conventional elongated bumper exhibiting detrimental variable energy absorbing characteristics along its length due at least in part to a kneading or stretching effect, are substantially overcome by incorporating the unique stabilizing rod 92 within the resilient body portion 91 of the bumper assembly 90. In one preferred embodiment, as best seen in FIG. 6, the stabilizing rod is preferably made of steel, and is axially disposed along the resilient body portion of the bumper assembly during the molding of the latter.

In order to ensure very rigid securement of the stabilizing rod within the composite bumper, the rod is preferably formed with a knurled or otherwise roughened surface as represented by the cross-hatched lines in FIG. 6. If desired, the stabilizing rod 92 may extend beyond the ends of the resilient body portion 91 so as to allow the independent mounting thereof on cooperative support structure (not shown) of the printer. This may be desirable in certain instances where the stabilizing rod is very rigid, such as when of appreciable diameter, and made of steel rod stock, for example.

It, of course, is understood, that many other metals, as well as plastic materials, may be employed to form the stabilizing rod, as long as the material exhibits the desired rigidity and thermal coefficient of expansion so as to minimize the kneading or stretching effect otherwise exhibited by the resilient plastic material of the bumper.

One preferred embodiment of the bumper assembly is depicted in FIG. 6, wherein the resilient body portion 91 thereof is preferably made of a polyester base urethane having a durometer Shore hardness of 90A, for example, and with a cross-section for one particular printer application of 0.250 inch by 0.250 inch, and a longitudinal length of nine inches, and wherein the coextensive stabilizing rod is preferably made of stainless steel having a diameter of 0.078 inch. The stabilizing rod material is preferably chosen from the A.I.S.I. 300 Series of low permeability chromium-nickel stainless steels, such as A.I.S.I. No. 303. Such a bumper assembly will exhibit exceptionally uniform energy absorbing characteristics (or viscous damping characteristics) along its length both before and after assembly in a printer of the type illustrated herein and, more importantly, throughout a prolonged period of extensive use in the printer.

Moreover, the desired energy absorbing characteristics of the bumper assembly will not vary appreciably even when the printer is subjected to operating environments that vary appreciably from normally accepted conditions with respect to temperature and humidity. As a result, the line definition of the printed characters will be considerably more uniform and distinct for reading than was ever possible with a conventional bumper, even when constructed of the same resilient material, but excluding the stabilizing rod mounted therewithin in accordance with the principles of the present invention.

There is another advantage that may often be realized from utilizing a stabilizing rod within the resilient body portion of the bumper assembly 90. This relates to the fact that the degree of resiliency (or viscous damping) exhibited by the material for the outer body portion 91 may be chosen to more effectively cushion a variable range of impact forces exerted thereagainst by the fired print hammers than could otherwise be possible with the same material, when unstabilized, because of the aforementioned troublesome kneading or stretching problems encountered heretofore. To that end, the stabilized resilient body portion may be employed to compensate for, or a least tolerate, an appreciably wider range of variable impact hammer forces that may result, for example, from the variable thicknesses of paper, or number of sheets (or plies of paper) typically encountered in practice.

Figure 7:
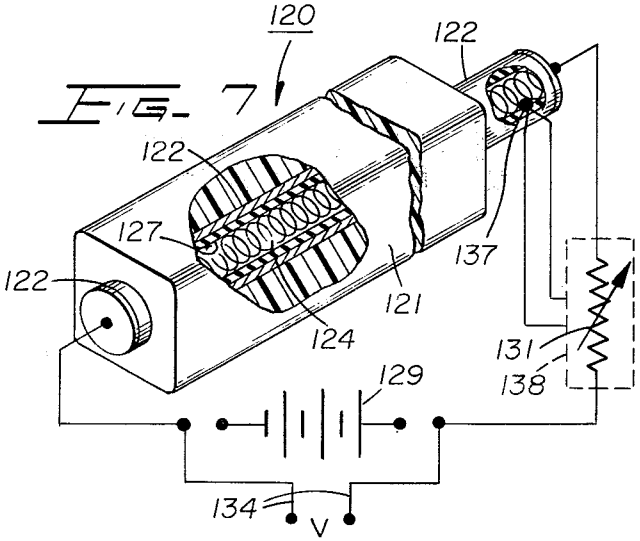
FIG. 7 is a perspective detail view, partially broken away, illustrating an alternative resilient energy absorbing bumper assembly, incorporating an axially disposed tubular stabilizing rod with an internal heater mounted therein, and further depicting a simplified schematic circuit for supplying current to the heater, as also embodied in the present invention.

FIG. 7 depicts an alternative energy absorbing bumper assembly 120 wherein a stabilizing rod 122 of tubular configuration is employed. The primary purpose of utilizing a hollow stabilizing rod is to allow a conventional miniaturized resistance heater element 124, such as in the form of a fine gauge helically wound wire, to be longitudinally mounted therewithin. A suitable insulative jacket 127 is employed between the heater element 124 and the inner wall of the tubular stabilizing rod so as to isolate the heating element from the rod when the latter is made of metal. Such an insulating jacket would, of course, be optional if the stabilizing rod were made of a suitable plastic material.

As the power required to maintain the temperature of the resilient body portion of the bumper assembly within a desired range is minimal, typically of the order of a fraction of a watt, the power source may simply comprise a battery source 129, as depicted, preferably with a variable resistor 131 so as to provide control of the current applied to the heater element. Conversely, if desired, the heater element 124 may be applied with current from any other suitable power source, such as with commercial a-c power designated V supplied through a pair of terminals 134, also depicted in FIG. 7. Local battery versus external power sources may be readily interchanged either by simple strap option connections, as depicted, or by a suitable switch, such as a conventional double pole-double throw switch (not shown).

In certain situations it may also be desirable to incorporate a thermo-couple 137, shown only symbolically in the tubular stabilizing rod 122, to maintain automated control of the temperature of the resilient bumper material for a given printer (or other) application. In that event, the thermo-couple could be connected, for example, to a conventional thermostatically controlled rheostat, represented only symbolically by the dash-lined box 138, which would replace variable resistor 131. The bumper assembly 120, of course, is particularly advantageous for use in printers that are operated in environments wherein the temperature and/or humidity may vary over considerably wide ranges. This could result in the thermal coefficient of expansion of the resilient bumper material causing the outer body portion to expand or contract by a sufficient amount so as to adversely affect the resiliency or viscous damping characteristics thereof. Extreme variations in temperature and/or humidity are often encountered, of course, in mobile printer applications.

It should be appreciated that the tubular construction of the stabilizing rod 122 may also be employed even when a heater element is not intended for use therewith. For example, such a rod may be desired simply to reduce the amount of material required, and/or to reduce the weight of the composite bumper assembly.

In all other respects, the heated energy absorbing bumper assembly 120 of FIG. 7 is preferably constructed of the same materials, and fabricated in the same manner as the bumper assembly 90 of FIG. 6 and, thus, may be utilized in an interchangeable manner to function in impact print hammer mechanisms of the type depicted in FIGS. 1–5.

In summary, several energy absorbing print hammer bumper assemblies have been disclosed herein which incorporate an axially disposed stabilizing rod that will substantially minimize the troublesome kneading or stretching effects otherwise often encountered heretofore in elongated bumpers made of materials exhibiting the requisite resiliency and viscous damping characteristics. Minimizng variations in the physical dimensions of the outer resilient body portion of the bumper assembly along its axial length, in turn, substantially increases the uniformity of the energy absorbing or damping characteristics therealong, even should the assembly be subjected to operating conditions wherein the temperature and/or humidity may vary appreciably. The composite bumper assemblies embodied herein also advantageously allow the stabilizing rod, whether of solid or tubular construction (the latter from allowing a heater element to be incorporated therewithin), to be readily and permanently embedded within the outer resilient body portion during a molding operation.

In view of the foregoing, it is obvious that various modifications may be made to the present illustrative embodiment of the invention, and that a number of alternatives may be provided without departing from the spirit and scope of the invention.

What is claimed is:

1. A resilient bumper assembly for use in impact hammer mechanisms comprising:

an elongated resilient body portion formed out of a plastic resinous material in the form of a polyester base urethane exhibiting a durometer Shore hardness in the range of 60A–95A and a Shore impact resilience by vertical rebound reading not exceeding 8%; and a rigid stabilizing rod positioned within and extending along the length of the resilient body portion of the bumper assembly, said stabilizing rod being made of metal and being embedded in the resilient body portion along their coextensive lengths said metal stabilizing rod having a tubular configuration, and an elongated heater element axially disposed within said tubular rod.

2. A resilient bumper assembly in accordance with claim 1, wherein said assembly further includes an insulating jacket interposed between the inner wall of said rod and said heater element, and voltage control means and voltage biasing terminals connected to said heater so as to maintain the temperature of said bumper assembly within a predetermined range when voltage is applied to said heater element.

3. In an impact printer including a hammer mechanism comprising a plurality of logic controlled and selectively actuable print hammers disposed in a lateral array, with each hammer having a longitudinally disposed slot formed therein, said mechanism further comprising:

an elongated resilient bumper assembly positioned so as to axially extend through said slots in said laterally aligned array of print hammers, said bumper assembly including:

an elongated resilient body portion formed out of a polyester base urethane material exhibiting a durometer Shore hardness in the range of 60A–95A said resilient body portion serving to substantially completely absorb any kinetic energy imparted hammer return impact forces applied thereagainst.

a rigid stabilizing rod positioned within and extending longitudinally along the entire length of the resilient body portion of the bumper assembly, said stabilizing rod being rigidly secured to the resilient body portion so that said resilient body portion is prevented from appreciably changing dimensions along its length during use, and said rigid stabilizing rod being made of metal, having a tubular configuration, the outer surface of said tubular rod being knurled so as to facilitate the rigid securement thereof to said resilient body portion of said bumper assembly and an elongated heater element axially disposed within said tubular rod.

4. In an impact printer hammer mechanism in accordance with claim 3, said bumper assembly further including an insulating jacket interposed between the inner wall of said tubular rod and said heater element, and voltage control means and voltage biasing terminals connected to said heater so as to maintain the temperature of said bumper assembly within a predetermined range when voltage is applied to said heater element.

5. In a printer mechanism including a moving type carrier having at least one font of type characters positioned therealong, a plurality of logic controlled and selectively actuable print hammers disposed in a lateral array with each hammer having a longitudinally disposed slot formed therein, said combination further comprising:

an elongated resilient bumper assembly including means for positioning said bumper assembly so as to extend axially through the slots in said hammers, and said bumper assembly being dimensioned relative to said hammer slots so as to allow a predetermined amount of reciprocal movement of said hammers, perpendicular and relative to said bumper assembly, said bumper assembly including:

an elongated resilient body portion molded out of a polyester base urethane material exhibiting a durometer Shore hardness in the range of 60A–95A, said range of hardness providing sufficient resiliency to allow said hammers to be cushioned thereagainst and substantially completely absorbing any kinetic energy imparted hammer return impact forces applied thereagainst.

a stabilizing rod positioned within and extending axially along the entire length of the resilient body portion of the bumper assembly, said stabilizing rod being rigidly secured to the resilient body portion along their coextensive lengths and being made of a material that prevents said resilient body portion from appreciably changing dimensions along its length and, thereby, maintaining the energy absorbing characteristics of said resilient body portion substantially constant and uniform:

said stabilizing rod being of metal, having a tubular configuration, and with the outer surface being knurled so as to facilitate the rigid, embedded securement thereof to said resilient body portion of said bumper assembly, and said resilient body portion exhibiting a durometer Shore hardness in the range of 60A–95A, and a Shore impact resilience by vertical rebound not exceeding 8%;

said bumper assembly further includes a heater element within said tubular rod, and an insulating jacket interposed between the inner wall of said tubular rod and said heater element, and controllable voltage biasing means connected to said heater so as to maintain the temperature of said bumper assembly within a predetermined range when subjected to variable operating conditions.

6. In a printer mechanism in accordance with claim 5, said heater element comprising a fine gauge helically wound wire element, and said means for positioning said bumper assembly comprising a support structure including a plurality of spaced fingers which are apertured to receive and rigidly support said bumper assembly at longitudinally disposed points along the length thereof, which points are interposed between successively adjacent print hammers.

* * * * *